United States Patent [19]

Slotar et al.

[11] 4,375,868

[45] Mar. 8, 1983

[54] MAILING DEVICE

[76] Inventors: Allan H. Slotar, 34 A 12th St., Parkmore, Sandton, Transvaal; Peter B. Cramer, P.O. Box 3652, Johannesburg 2000, both of South Africa

[21] Appl. No.: 301,305

[22] Filed: Sep. 11, 1981

Related U.S. Application Data

[63] Continuation-in-part of Ser. No. 163,330, Jun. 26, 1980, abandoned.

[51] Int. Cl.[3] ..... B65D 27/00

[52] U.S. Cl. ..... 229/92.3; 282/11.5 A

[58] Field of Search ..... 229/92.3, 92.8, 92.9, 229/71, 73, 92.1; 282/11.5 A, 15 R

[56] References Cited

U.S. PATENT DOCUMENTS

| | | | |
|---|---|---|---|
| 1,307,421 | 6/1919 | Schramm | 229/92.3 |
| 2,340,700 | 2/1944 | Sawdon . | |
| 3,869,080 | 3/1975 | Anderson | 282/11.5 A |
| 3,899,381 | 8/1975 | O'Brien | 282/11.5 A |
| 4,051,995 | 10/1977 | Wieman | 282/11.5 A |
| 4,055,294 | 10/1977 | Traise . | |
| 4,148,430 | 4/1979 | Drake | 229/92.3 |

*Primary Examiner*—Herbert F. Ross

*Attorney, Agent, or Firm*—Stanley J. Price, Jr.; John M. Adams

[57] ABSTRACT

A mailing device is in the form of a single sheet of paper which can be folded over on itself to form its own envelope. The device is a single sheet, which may be formed with portions of different paper qualities, and is to be folded in half and then in half again to put it in a form ready for mailing. In its once folded state, the device can be printed with the necessary message using a mechanized printer, and the address of the recipient can be printed on the same surface of the device as the message, and the address will appear on the correct face of the device when it is folded again.

10 Claims, 7 Drawing Figures

FIG_1
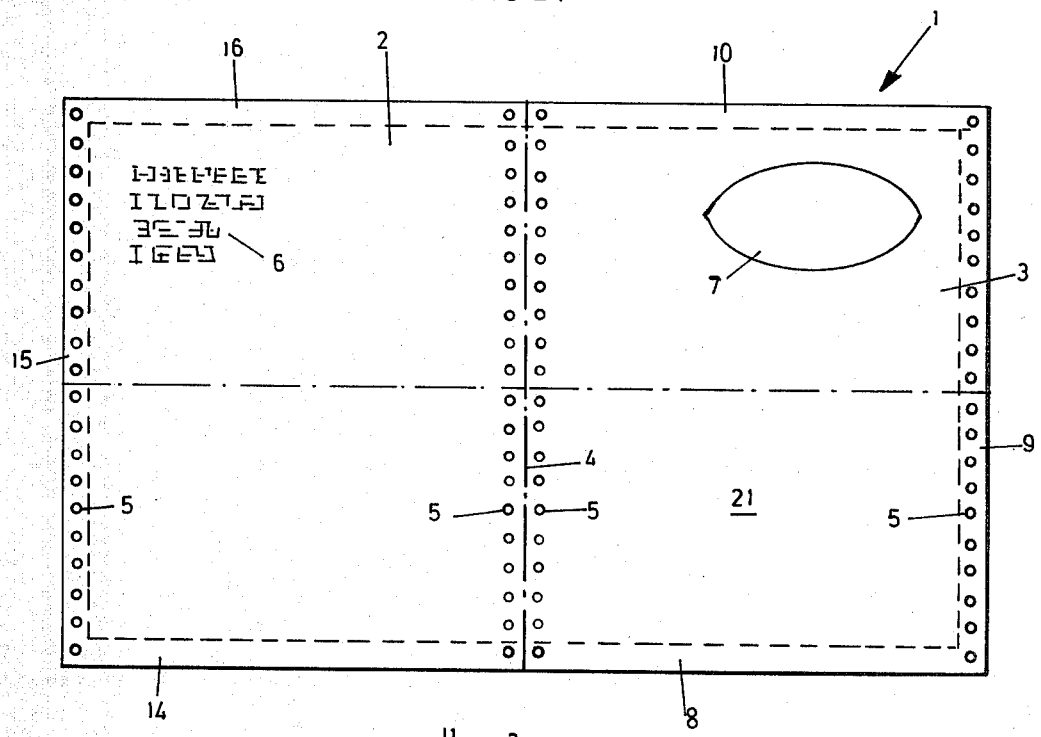
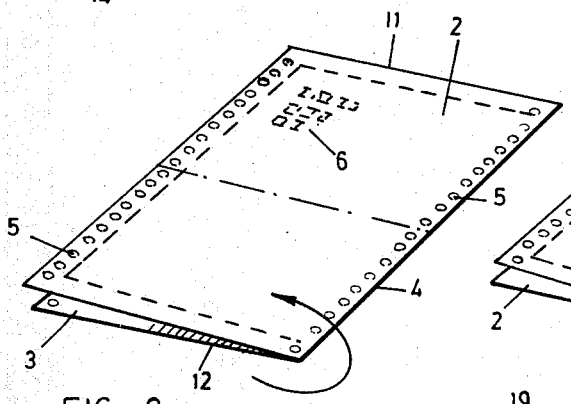
FIG_2
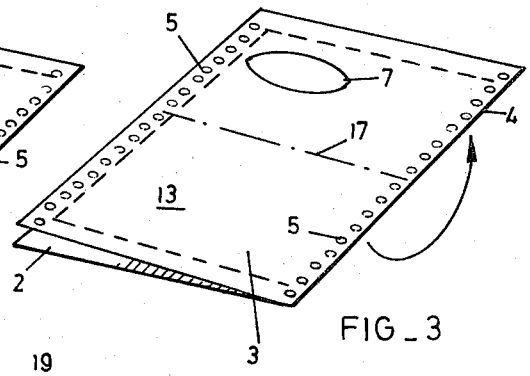
FIG_3
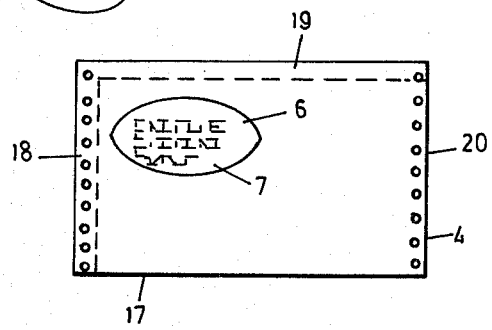
FIG_4

MAILING DEVICE

This application is a continuation in part of co-pending application, Ser. No. 163,330 filed June 26, 1980, entitled "Mailing Device" now abandoned.

FIELD OF THE INVENTION

This invention relates to a mailing device by means of which information can be written down and mailed to a recipient making use of a single piece of paper.

BACKGROUND OF THE INVENTION

Mailing devices of this general type are known. The simplest and best known form may be an airmail letter which has gummed edges and can be folded together to form its own envelope. Other devices are known (see for example British Patent Specification No. 1,555,140) where information is printed or typed on one side of the paper only, and where the recipient's address appears through a window once the paper has been folded.

U.S. patent specification No. 2,340,700 (Sawdon) discloses a multiform envelope having four main sections and including a return envelope. Information is printed on this device in at least two diagonally opposite sections before folding it to form an envelope. The device is not suitable for printing by a mechanized device such as a computer printer, and is not suitable for use in the form of "continuous stationery," as used in mechanized printers.

U.S. patent specification No. 4,055,294 (Traise) discloses a combined mailer and return envelope assembly which is in the form of a continuous web, with adjacent assemblies along the length of the web joined to one another by rows of perforations. Web feed holes are provided at the web margins so that the assemblies can be fed through a computer printer. This assembly has a relatively small area for bearing printed matter for the information of the addressee, and is a very complicated construction.

SUMMARY OF THE INVENTION

It is an object of the invention to provide a mailing device which can be readily processed and printed using a mechanized printing unit such as a computer printer.

It is a further object of the invention to provide a mailing device which has a relatively large area on one face of the opened device for bearing information.

It is another object of the invention to provide a mailing device which is simple to put into a form ready for mailing after being processed by the printing unit.

According to the invention, there is provided a mailing device in the form of a single sheet of paper folded about a center fold line so that a first half of the sheet overlies a second half and adapted to be processed by a printing unit in the folded state, means for permitting an address written on a predetermined area of the first half to be viewed when the second half has been folded over on top of the first half, the sheet being adapted to be folded into four quarters about a fold line at right angles to the center fold line and having detachable gummed margins adapted to secure the sheet in its twice-folded position with the four quarters overlying each other.

The term "printing unit" used in this specification includes any mechanized printing unit such as a computer printer, the unit preferably automatically feeding the device as printing takes place.

A relatively large amount of printed information can be conveyed using a single sheet which does not require a separate envelope for posting it. The devices can be made in the form of a continuous web (i.e. continuous stationery), so that each device can be torn off from the succeeding device following printing.

Two alternative ways of permitting an address written on the first half to be viewed when the second half has been folded over are suggested.

In a first manner, the second half may have a window at a position corresponding to the predetermined area on the first half, so that the address written on the first half is viewed directly through the window once the second half has been folded over.

In a second manner, the underside of the predetermined area of the first half is provided with carbon paper, or the like, so that the address typed on the first half is reproduced on the upper surface of the second half. When the second half is folded over, the reproduced address will then be on the outer surface. Of course, any other method of transferring images from one surface to another, such as a carbonless system, may be used between the first and second halves.

The first and second halves may be made of different paper qualities, joined in the region of the center fold line. Since the two halves will be permanently joined, the device with two different qualities of paper will continue to be referred to as a single sheet.

The gummed margins may be separated from the remainder of the sheet by means of a line of perforations. Lines of perforations may also be used to separate the rows of transport holes from the rest of the device.

BRIEF DESCRIPTION OF THE DRAWING

The invention will now be further described, by way of example, with reference to the accompanying drawing, in which:

FIG. 1 shows a mailing device according to the invention opened out into a flat condition;

FIG. 2 shows the device of FIG. 1 in the normal form in which it is supplied;

FIG. 3 shows the device of FIG. 2 after one fold;

FIG. 4 shows the device of FIG. 2 after two folds, and

DETAILED DESCRIPTION OF A PREFERRED EMBODIMENT

Figure 5:
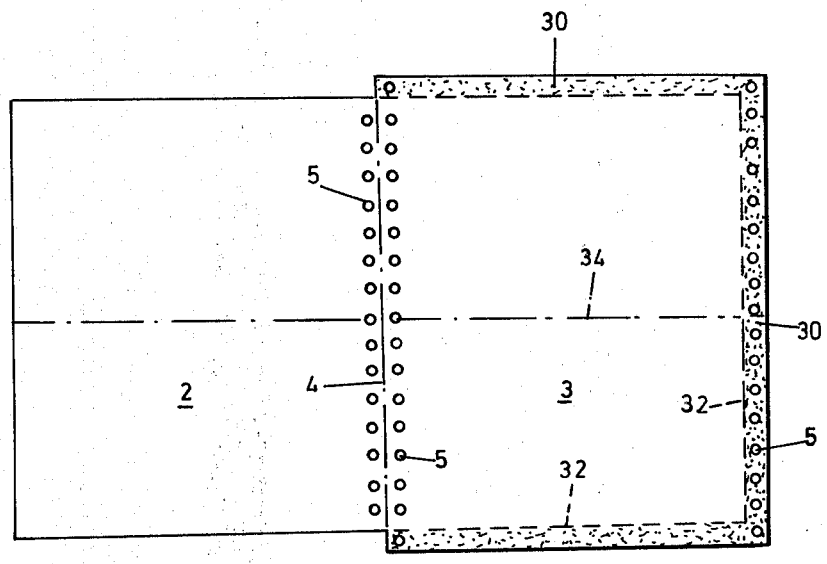
FIGS. 5 to 7 illustrate a mailing device according to another embodiment of the invention.

The device shown in FIG. 1 is suitable for processing by a computer-driven printer and consists of a single sheet 1 made up of a first half 2 and a second half 3. A fold line 4 extends between the two halves. Generally, in the drawings fold lines will be indicated by chain-dotted lines, whereas lines of perforations will be indicated by ordinary dotted lines.

Both halves 2 and 3 have rows of holes 5 adjacent each edge for transport of the device through a printing unit. The half 2 has an area 6 where an address can be written, and the half 3, in the embodiment shown in the drawings, has a window 7 at a position which corresponds to the address area 6. The margins 8, 9, 10 of the second half 3 are gummed. The gum may be of the type which only sticks to itself.

The device as supplied to a user will be folded into the form shown in FIG. 2. The transport holes 5 in the half 2 register with the holes in the half 3, so that sprockets or other transport mechanisms on the printing units can project through both halves.

The gummed margins 8, 9, 10 will be on the lower, outwardly facing surface of the half 3.

In use, the address of the recipient is typed in at 6. Other information is then printed on the remaining area of the half 2. This may, for example, be information regarding an account. No information is printed by the printing unit on the half 3 although, as previously discussed in an embodiment which is not shown in the drawings, there may be a mechanism between the two halves for transferring the address typed at 6 on to the upper, inner surface of the sheet 3.

Once the necessary information has been typed or printed on the device, it is fed out of the printing unit and, if necessary, is separated from a succeeding device which may be attached by means of perforations along one of the edges 11 or 12.

The half 3 is then folded out from underneath the half 2, and over the top of the half 2, to the position shown in FIG. 3. The address at 6 can then be seen through the window 7.

If required, the senders name and address can be pre-printed in the area indicated by numeral 13 on the outside of the half 3. It will be appreciated that the gummed margins 8, 9, 10 are now on the lower side of the half 3, i.e. between the two halves. At this stage, again there are two alternative methods by which the device may be secured in a folded position. In a first alternative, both sides of the margins 14, 15, 16 may be gummed. In this case, in the position shown in FIG. 3 the two halves will adhere to one another.

In a second alternative, the margins 14, 15, 16 may be detached from the half 2 at this stage, so that the gummed margins 8, 9, 10 of the half 3 extend beyond the periphery of the half 2.

In the next stage of folding, the device is folded about line 17 to the position shown in FIG. 4. This is the final fold, and the four quarters of the sheet will be held together at least along edges 18 and 19. Following the first alternative detailed above, the lower faces of the margins 14, 15, 16, as seen in FIG. 3, would stick to one another to maintain the FIG. 4 position. In the second alternative, where the margins 14, 15, 16 have been removed, the margins 8 and 10 would adhere to one another and the lower half of the margin 9 would adhere to the upper half of the margin 9.

At the edge 20, there will be an opening between the two halves 2, 3. If necessary, local dots of gum may be provided along this edge to close the opening.

The device is then ready to be mailed. To open it, the recipient only needs to tear off the two margins at 18 and 19 along the associated perforations, and the device can be folded out.

It will be noted that the half 3 effectively forms an "envelope" for the half 2. The half 3 may therefore may made of a stouter or more opaque paper than the half 2. If the two halves of the sheet are made from different paper qualities, they may be joined by gluing together overlying marginal edges on one side or the other of the fold line 4.

The side of the half 3 indicated by the numeral 21 in FIG. 1 may be pre-printed with advertising matter or decorative matter, because this will appear to the recipient side-by-side with the individual printed information on the other half, when the device has been fully opened out.

The window 7 may or may not have a transparent pane. The shape of the window shown in the drawings has been especially evolved so as not to require a pane. It is found that when a window of this shape without a pane is processed through automatic franking machines, the machinery tends to fold the window-containing sheet portion flat against the rest of the device and has no tendency to catch in the window opening.

It is a particular advantage of the device described that it is particularly designed for use with automatic printing units. A very large area is available for conveying information, bearing in mind that this is a device which is used without a separate envelope.

It should be pointed out that the incorporation of the window 7 is not essential and it may be dispensed with if carbon paper or some other mechanism is employed to duplicate or otherwise reproduce the address which is applied to the address area 6 on the upper, inner surface of the sheet 3, with the device in the FIG. 3 configuration.

Figure 6:
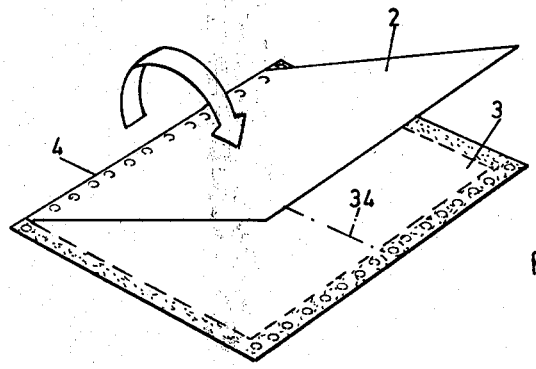
Figure 7:
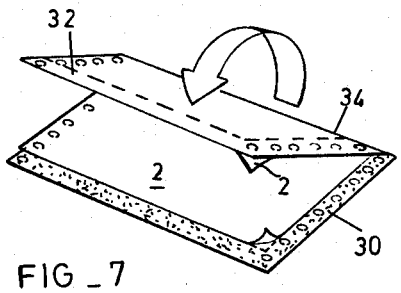

The mailing device in FIGS. 5 to 7 differs from that shown in FIGS. 1 to 4 in that the step of folding the half 3 through 360°, to change the device from the FIG. 2 configuration to the FIG. 3 configuration, is dispensed with.

Referring to FIGS. 5 to 7 the mailing device there illustrated has two halves 2 and 3 respectively which may be integral with each other or otherwise formed from different pieces of paper of the same or different qualities joined together.

FIG. 5 shows the mailing device opened out. The two halves adjoin each other along a central fold line 4. The half 3 has a larger area than the half 2, the excess area being constituted by gummed margins 30 which are severable along lines 32 of perforations. Transport holes 5 are formed in the halves as shown in FIG. 5.

The half 2 in this example forms a letter sheet which may carry preprinted information. The half 3 on the other hand is destined to form an envelope.

The device is fed through a printer or similar device as an element of a continuous stationery stack. The half 2 is, however, folded over, as shown in FIG. 6, so that it overlies the half 3 and carbon paper is located between the two halves with the carbon face in contact with the half 2.

The mailing device is thus transported through the printer in the folded state shown in FIG. 6 with the outer surface of the half 3 uppermost so that it is exposed to the printer. Thus if an address is printed on the half 3 it is reproduced via the carbon sheet on the half 2. It should be mentioned that the mailing device, which may for example comprise a statement or invoice, can be processed simultaneously with other items such as delivery notes, customer advice notes, etc.

After printing the mailing device is severed from the continuous stationery and the carbon paper is removed.

The device is then folded about a central transverse fold line 34 into four quarters, as shown in FIG. 7, and the gummed margins then retain the device in the folded state.

To open the letter the recipient merely detaches the margins by tearing along the lines 32 of perforations. The letter, i.e. the half 2 can then be folded open for reading.

In each embodiment of the invention the transport holes 5 have been illustrated as being positioned in a margin which is gummed. If the gummed surface causes problems during processing, e.g. if the adhesive displays a tendency to adhere to the transport mechanism then the adhesive can be applied to the paper on the opposite side of the line of perforations, and not to the marginal portions.

We claim:

1. A mailing device comprising; a single sheet of paper having a center fold line which divides the sheet into first and second halves, the sheet being folded about said line so that one half overlies the other half; means adjacent the folded edge and the edge parallel to said fold facilitating the travel of the device through a printing unit in the folded state; means for permitting address information on a predetermined area of the first half to be viewed when the second half has been folded about said fold line on top of the first half; a fold line at right angles to the center fold line and about which the sheet can be folded into four quarters; and detachable gummed margins for securing the sheet in its twice-folded position with the four quarters overlying one another.

2. The device of claim 1 wherein the means facilitating the travel of the device are series of holes in opposite margins of the folded sheet, for co-operation with transport sprockets of a printing unit.

3. The device of claim 1, wherein the second half is provided with a window at a position corresponding with the predetermined area of the first half, so that an address printed on said predetermined area can be viewed when the second half has been folded on top of the first half.

4. The device of claim 1, wherein an image reproducing means is provided between the first and second halves at a position corresponding with the predetermined area of the first half, so that an address printed on said predetermined area is reproduced on a corresponding area of the second half and the reproduced address is visible when the second half has been folded over on top of the first half.

5. The device of claim 4, wherein the image reproducing means is carbon paper on the underside of the first half.

6. The device of claim 1, wherein the first and second halves are of different paper qualities.

7. The device of claim 6, wherein the second half is of a stouter and more opaque paper than the first half.

8. The device of claim 6, wherein the second half is preprinted.

9. The device of claim 1, wherein an image reproducing means is provided between the first and second halves at a position corresponding with the predetermined area of the first half, so that an address printed on the second half is reproduced on the said predetermined area, and the address on the second half is visible when the second half has been folded over on top of the first half.

10. The device of claim 9, wherein the image reproducing means is carbon paper on the underside of the second half.

* * * * *